United States Patent [19]

Frank

[11] 4,417,560

[45] Nov. 29, 1983

[54] INTAKE AIR BOOSTER FOR AN INTERNAL COMBUSTION ENGINE

[76] Inventor: Eugene O. Frank, Box 64, Caldwell, Id. 83605

[21] Appl. No.: 281,908

[22] Filed: Jul. 9, 1981

[51] Int. Cl.[3] ..... F02B 33/40

[52] U.S. Cl. ..... 123/559; 417/352

[58] Field of Search ..... 123/559, 564, 565; 417/352, 408

[56] References Cited

U.S. PATENT DOCUMENTS 2,281,202 4/1942 Nelson ..... 417/352

3,020,901 2/1962 Cook ..... 123/559

FOREIGN PATENT DOCUMENTS 1018972 2/1966 United Kingdom ..... 417/352

OTHER PUBLICATIONS

"Science and Mechanics", Oct. 1967, pp. 62, 86, 87.

*Primary Examiner*—Michael Koozo

*Assistant Examiner*—Peggy A. Loiacano

*Attorney, Agent, or Firm*—Blair, Brown & Kreten

[57] ABSTRACT

An intake air booster for boosting air flow in an internal combustion engine or the like which includes a first air passageway communicating directly with an engine intake manifold having a plurality of interleaved rotating and stationary blades, the rotating blades forming a second internal passageway, the stationary blade providing an outer housing, so that air passing through this first passageway will be stirred by virtue of the interaction against these blades; the second air passageway formed by an internal band contained on the rotating blades includes caps on bottom and top portions of the passageway provided with a plurality of inlets and outlets and a source of compressed air adapted to engage the cap and by so doing providing additional air through the air passageway while simultaneously increasing the rotation of the rotary blades in the first air passageway, the source of compressed air including a reservoir and appropriate valving and sensing means which selectively engage the compressed air for the additional throughflow. In this manner, beneficial air can be combined with an increased fuel delivery for more efficient combustion and power.

11 Claims, 5 Drawing Figures

FIG 3
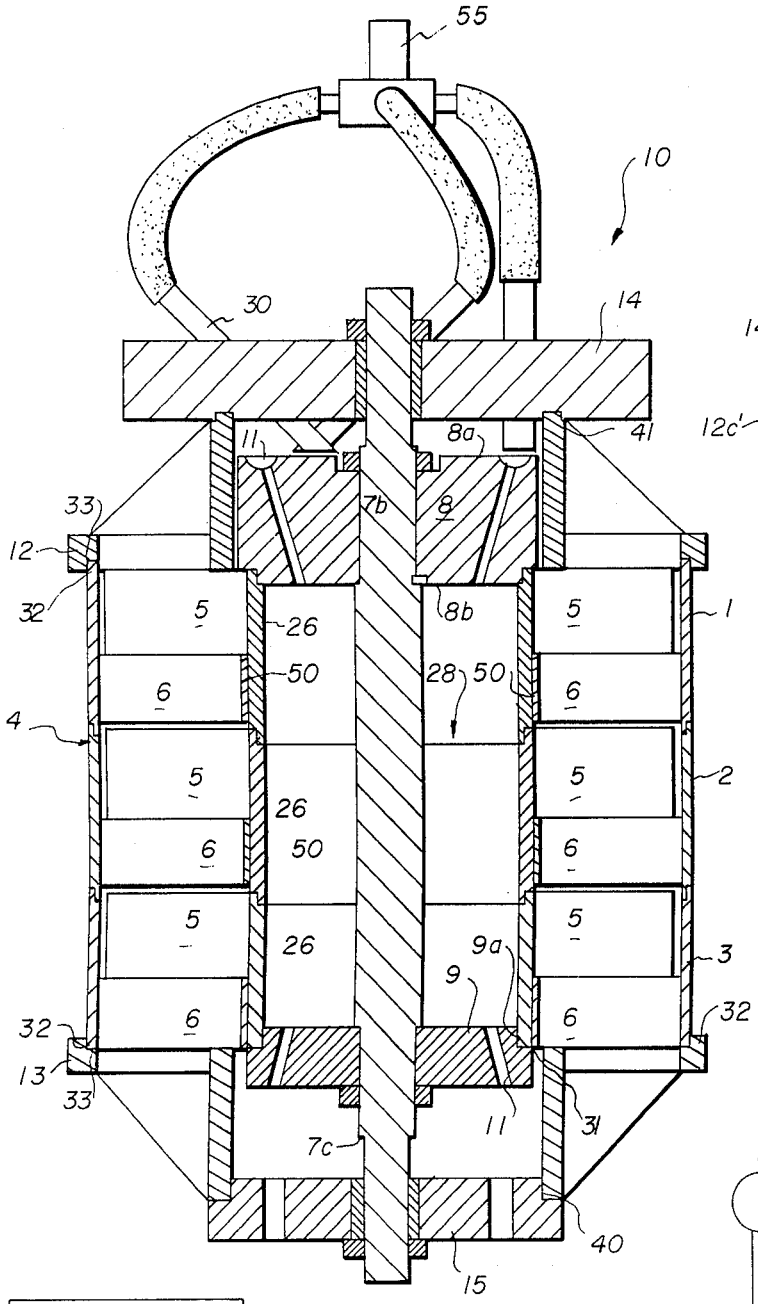
FIG 4
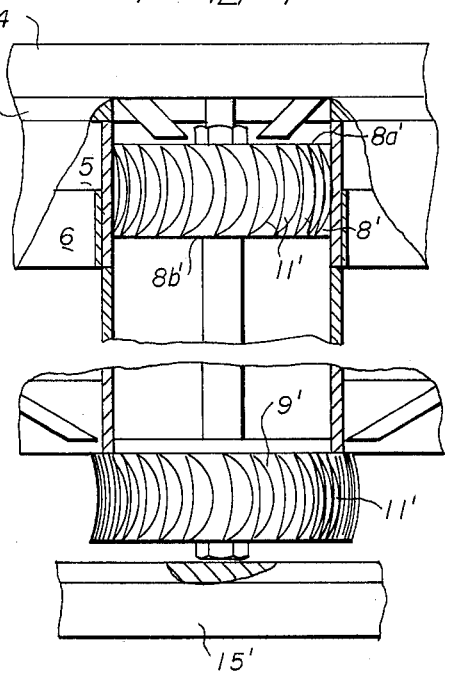
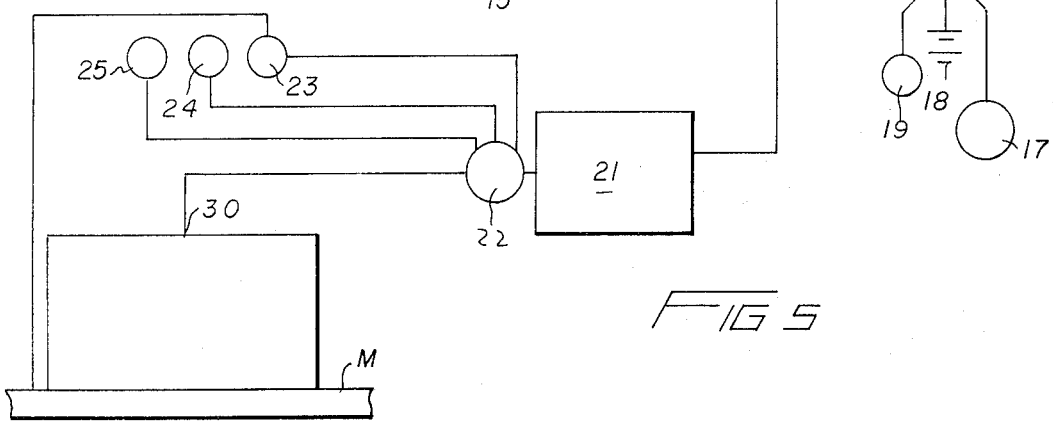
FIG 5

INTAKE AIR BOOSTER FOR AN INTERNAL COMBUSTION ENGINE

BACKGROUND OF THE INVENTION

The following invention relates generally to systems for increasing the intake air by providing a booster.

Internal combustion engines, especially those used in fuel injection systems in which the fuel is delivered directly into the combustion chamber or alternatively into an intake manifold in close proximity to the combustion area, are limited in the capacity to produce more power primarily by an upper limit on the amount of air and therefore oxygen capable of being delivered into the intake manifold so as to maintain the stoichiometric fuel ratio, a design ideal. In fact, the intake manifold and the air cleaner geometry on current cars is such that, given a fuel injection system, it is extremely difficult to induce the requisite amount of air and therefore oxygen in such a manner that it will keep pace with the engine's ability to deliver fuel upon demand, thereby resulting in a restriction in the engine's performance as far as power output in relation to its size while simultaneously increasing telltale amounts of nburned fuel in the exhaust system.

Historically, the quest in engine performance and emissions control has alway been to provide maximum atomization of the gasoline or fuel combined with an adequate air charge, to dispose same into a combustion chamber suitably formed to minimize quench area in the combustion chamber and to promote a beneficial flame pattern upon ignition.

The following patents reflect the state of the art of which applicant is aware in so far as these patents appear to be germane to the patent process.

| | |
|---|---|
| 3,007,626 Simpson | 3,849,086 Johnson |
| 3,020,901 Cook | 4,243,010 Zopfi |

Of these, the patent to Johnson teaches the use of supercharger for an internal combustion engine which is carbureted in which the dynamic supercharging produced is self generated as cylinder charging pressures are created by the vortex motion of the moving gases. This device may be more properly regarded as a baffle chamber since the vortexing gases within passageways are introduced into a large chamber creating additional vortex resulting in air and gas mixing within the combustion chamber.

The patent to Simpson teaches the use of three possible modes for supercharging and associated compressor units so as to compensate for variations in atmospheric pressure and the like. In various forms, the receiver 16 is called upon to deliver pressurized air into the air box of the engine based upon criteria relating to atmospheric pressure and the like sensed in valving.

Cook teaches the use of a supercharger for an internal combustion engine in which a compressor has a conduit extending to the intake manifold and also a branch network having appropriate valving for accommodating an air reservoir, and is mainly concerned with the sensing means for determining when to deploy the additional air charge contained within the reservoir.

The patent to Zopfi teaches the use of a fixed baffle air fuel mixture routing box in which air from a conventional carburetor butterfly is mixed with fuel and diverted into a compressor before admission into the intake manifold of an engine, and a spring biased pressure relief valve limits the pressure of the air fuel mixture fed to the engine. In this manner, the compressor must be designed to accommodate the solvent nature of the fuel and may provide problems in the longevity of the compressor device by stripping it of the lubrication necessary to provide maintenance free service.

By way of contrast, the instant application is directed to and claims an intake air booster for increasing air flow into an internal combustion engine or the like which includes a first air passageway communicating with an engine's intake manifold that is provided with means for altering the air flow rate in the passageway at all times without requiring a concomitant loss in engine power by providing a power takeoff or the like to run the compressor. Accordingly, when in this phase the engine runs more efficiently by virtue of the first air passageway. In addition however, a second air passageway is provided which communicates with the intake manifold as well in which the second passageway is powered by a compressor having an air storage facility sensitive to certain stimuli such as acceleration, certain criteria in exhaust gas, and associated drops in intake manifold pressure so that when energized the second air passageway not only provides a greater air input, but also induces the first air passageway to work more efficiently in providing a greater air charge.

The prior art devices that are turbo or directly driven superchargers, depend upon the amount of their output by prior acceleration of the engine i.e. for the supercharger to produce a greater flow of air, the engine must first accelerate, thereby driving the superchargers impellers faster and consequently increasing the capacity.

Accordingly, there is a time lag in which the supercharger is not effective, particularly at low speeds. Clearly, if a desired increase in air delivery is predicated on a process of getting the engine to run faster, that effect is hampered by the fact that the engine cannot accelerate efficiently without the additional air to begin with. By way of contrast, the storage facility and associated structure according to the instant application along with a new and novel air introduction device considerably shortens the response time for providing the needed air during increased fuel throughput thereby providing more rapid acceleration, a desired phenomena for example when passing or going up steep grades.

OBJECT AND SUMMARY OF THE INVENTION

Accordingly, this invention has as an object to provide the engine with an increased amount of oxygen by increasing the amount of air available to the intake manifold as a function of sensors in compliment with the engine.

It is yet a further object of this invention to provide a device of the character described above which is sensitive to a drop in intake manifold pressure.

It is yet a further object of this invention to provide a device of the character described above which is responsive to a sensed increase in fuel throughput.

It is still a further object of this invention to provide a device of the character described above which is sensitive to monitoring devices contained within the exhaust chamber of an automobile indicating excessively rich mixtures.

A further object of this invention is to provide a device of the character described above which is extremely durable in construction, safe to use, and relatively easy to install.

It is yet a further object of this invention to provide a device of the character described above which is relatively inexpensive to manufacture, and lends itself to mass production techniques.

It is still a further object of this invention to provide a device which provides beneficial oxygen to the engine during critical moments such as acceleration or changing altitudes or the like to increase safety factors.

It is still a further object of this invention to provide a device of the character described above in which the density of the air is increased so as to provide an oxygen enriched charge of air into the engine.

It is still a further object of this invention to provide a device of the character described above in which the enriched air is in storage and available at an instant's notice; that when the demand does not exist, the hardware associated with the apparatus according to the instant application is allowed to idle and to provide no objectionable drain on the engine's reserve by virtue of other design considerations according to the apparatus set forth hereinafter.

More specifically, this invention has other related objects which will be made manifest when considering the following detailed specification taken in conjunction with the appended drawing figures in which there has been provided an intake air booster for increasing air flow to an internal combustion engine in which a first air passageway communicates with the engine's intake manifold and stirs the air available therein, which includes a first passageway having a means for increasing the air flow, a second air passageway having a means for simultaneously and selectively increasing the air flow rate in both the first and second passageways, a compressed air means operatively providing air to the second means for simultaneously and selectively increasing the air flow rate, sensing means for actuating said compressed air means, impeller means disposed on said second air passageway to improve the air throughflow and simultaneously to accelerate air through the first air passageway which has rotary and stationary vane means disposed therein, in which the entire apparatus is provided with fastening means and suitably dimensioned to be accommodated in a relatively small space available in most vehicle engines compartments, the device lending itself to ready installation with current engine design.

BRIEF DESCRIPTION OF THE DRAWING FIGURES

FIG. 2 is a side view of the assembled apparatus;

FIG. 3 is a sectional view taken along lines 3—3 of FIG. 2;

FIG. 4 shows an alternative embodiment of a second impeller shown in FIG. 1; and FIG. 5 is a schematic presentation of the apparatus in its environment.

BRIEF DESCRIPTION OF THE PREFERRED EMBODIMENTS

Figure 1:
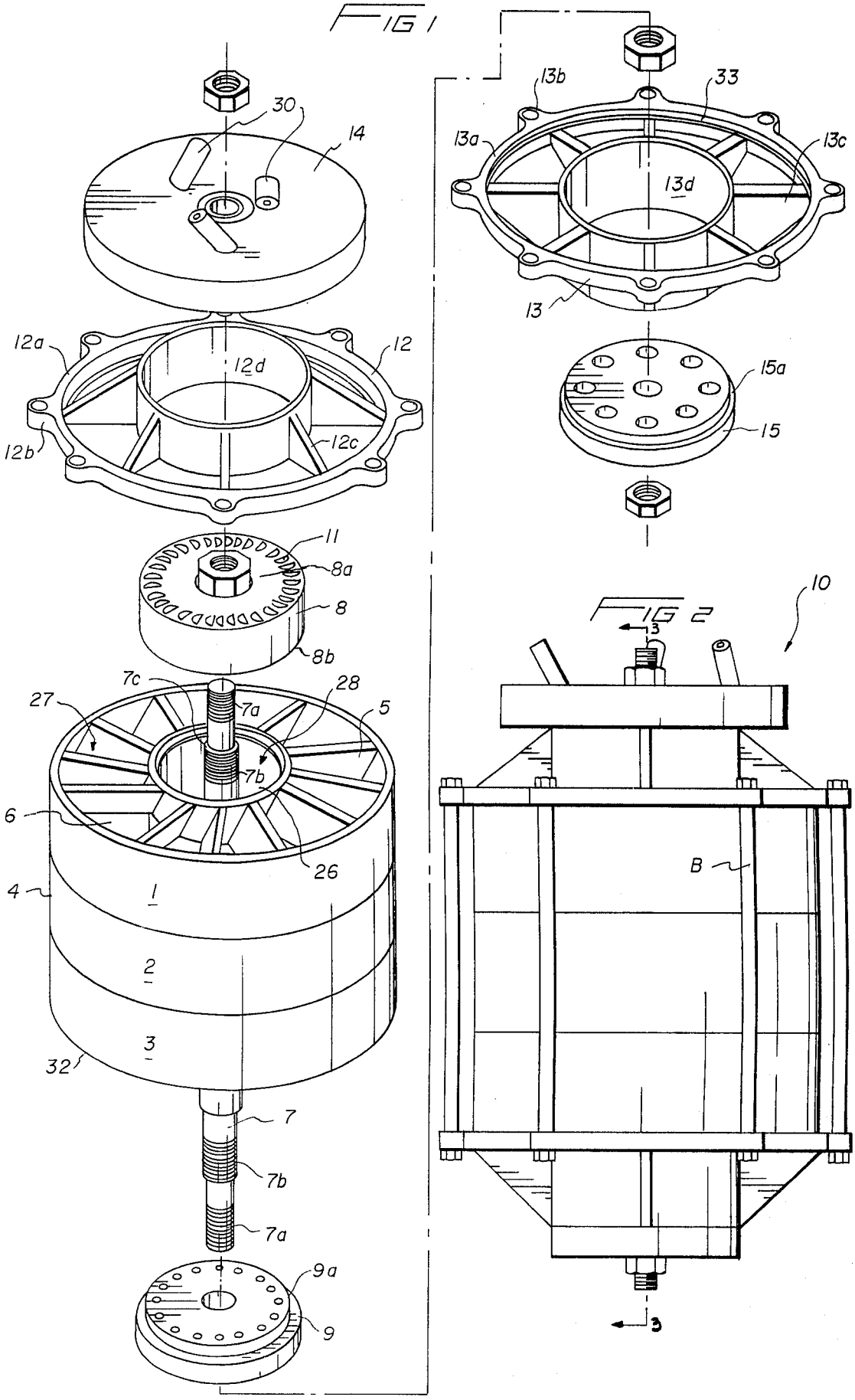
FIG. 1 is an exploded parts view of the apparatus according to the present invention.

Referring to the drawings now wherein like reference numerals refer to like parts throughout the various drawing figures, reference numeral 10 is directed to the intake air booster according to the present invention.

The booster 10 includes a housing 4 of substantially cylindrical configuration formed from plural sections 1, 2 and 3 etc. respectively being merely illustrative of a means for ganging together or stacking the device to accommodate various engine requirements, in which each section 1, 2, 3, includes a rotary vane 5 and a stationary vane 6. The stationary vane 6 is formed integrally with the housing 4, and the vane 6 is defined by a plurality of radially inwardly extending vanes all of equal length terminating on an annular inner sleeve 50. The rotary vane 5 extends substantially to the inner face of the housing 4 and emanates at oblique angles from a central band 26 of substantially annular configuration a portion of which resides within sleeve 50, the axial length of the central band and each housing section being of substantially of the same dimension so that whereas the stationary vane has a housing portion within which the rotary vane rides, the rotary vane has a band portion to which the stationary vanes are adjacent.

A plurality of central bands 26 which when stacked one upon the other form an internal core which defines a second air passageway 28 to be described hereinafter, and plural such housings, bands, etc. are provided with nesting means which allow the plural sections to be stacked. The first air passageway 27 defines an concentric annular space around the second air passageway 28, so that normal ambient air when introduced into the first air passageway will encounter the rotary vanes 5, and by the air reacting against the stationary vanes 6 a compressive effect is experienced, such that a certain amount of air is delivered to the intake manifold M disposed below the housing.

The second air passageway 28 is provided with upper and lower caps 8 and 9 respectively each of which serves as impeller means in an manner now to be defined. The upper cap 8 includes a plurality of apertures 11 extending from the top surface **8*a* through the bottom surface 8*b* in an oblique manner so that air impinging from an upper area downwardly will cause a rotation of the cap. Similarly, the lower cap 9 has further apertures 11 similarly dimensioned for the same effect. The caps are each frictionally engaged with respective band portions so that increased rotation of the caps necessitates a corresponding increased motion of the rotary vanes 5**.

Centrally disposed shaft 7 extends through the second air passageway 28 and the caps 8, 9, the shaft 7 having extremities with two threaded area **7*a* and 7*b*. The innermost threaded portions 7*b* extend just above and below the caps 8 and 9 when in an assembled condition so that a fastening means such as a nut can be threaded thereon to retain the housing in a fixed manner. In addition, nesting means are provided along all abutting surfaces, the lower cap 9 serving as an example wherein a shelf 9*a* registers with a depending lip 31 from the lowermost portion of a band 26. By virtue of this tight machine fit, a reliable driving engagement between the caps 8, 9 and the band 26 is assured. Unwanted displacement of the housing and caps is also assured by means of stepped portions 7*c* of the shaft 7 as best seen in FIG. 1**.

FIG. 1 also reveals an upper carrier frame 12, and lower carrier frame 13 which are adapted to overlie top and bottom edges 32 of the housing 4 as shown in FIG. 2, so that the first air passageway is not occluded. Specifically, each carrier frame includes an annular rib **12*a* having on a face proximate to the housing a groove 33** dimensioned to accommodate the edge 32 of the housing, and a plurality of radially outwardly extending eyelets 12*b*, 13*b*, adapted to receive and engage elongate bolts B for further support. Webbing 12*c*, 13*c*, extends radially inward from the annular rib 12*a*, 13*a* terminating in a carrier sleeve 12*d*, 13*d*, of cylindrical configuration, adapted to overlie and provide a container for the upper and lower caps 8, 9 respectively. The top area of the carrier sleeve is covered by means of an injector plate and nozzle support 14 on the upper portion thereof and a lower injector plate 15, both of which are stationary and fastened by means of nuts which threadedly engage the outermost threaded termini 7*a* of the shaft.

The injector plate and nozzle support 14 includes a plurality of nozzles 30 extending through the plate adapted to cause air to impinge upon the cap apertures 11. Thus, air extending through the nozzle 30 from a storage tank 21 through a manifold 55 will cause increased rotation of the rotary vane 5, and a throughput of air into the second air passageway 28. Note the nesting means 40, 41 on the upper and lower plates, which similarly frictionally engage the carrier sleeve 12*d*, 13*d* as was discussed in the nesting supra.

FIG. 4 teaches the use of a second embodiment for the impeller 8, the second embodiment 8' having a top surface 8*a'*, a bottom surface 8*b'* and plural apertures 11' which bow in such a way as to define an axis of symmetry beween the top and bottom surfaces, that is the apertures 11' form concave air foil type shapes when taken in section. In this embodiment, the impellers of 8' are disposed within the top and bottom bands 26. The lower impeller 9' can be frictionally fit as impeller 9 and has a portion underlying the lowermost stationary vane 6. A further nozzle 30 extending through housing 4 and adjacent the vane 6 discharges air on the aperture 11' as shown.

FIG. 5 is a schematic representation of a preferred environment for the intake air booster 10 according to the present invention in which the booster is operatively connected to a storage tank 21, and interposed therebetween, a valve 22 is selectively openable by any of a plurality of sensing means. Three such sensing means may be the manifold pressure drop 23 indicated by a diaphragm type switch located within the manifold M proper and capable of sending a signal to the valve 22: a sensor 24 indicative of throttle depression signaling the introduction of a larger fuel charge within the intake manifold and thence the combustion chamber; or an exhaust gas analyzer 25 in the exhaust manifold which senses an unduly rich mixture of unburned gasoline or fuel.

The storage tank 21 is filled by means of a pump 16 having interposed therebetween a check valve 20 to allow only the unidirectional flow of compressed air from the pump to the storage tank 21.

It is contemplated that pump can be driven by a number of means, schematically depicted are a belt drive off of an engine component, the belt 17 preferably connected to the crankshaft near the traditional timing cover, a source of electro motive force such as a battery 18, or may be energized by exhaust gases similar to a turbo charger 19.

In use and operation therefore it should be appreciated in the normal course of events, such as highway cruising speed, the first air passage 27 is more than adequate to provide a turbulent throughput of air than the prior art devices. Should acceleration take place, the reservoir having been charged will provide an air pulse into the secondary air passage 28 through the cap 8 and nozzle 30 thereby rotating the vanes 5 as described hereinabove and further inducing a larger amount of air into the intake manifold.

Moreover, having thus described the invention, it should be apparent that numerous structural modifications are contemplated as being a part of this invention as set forth hereinabove and defined hereinbelow by the claims.

What is claimed is:

1. An intake air booster for increasing air flow for an internal combustion engine having an intake manifold or the like comprising, in combination:

a first air passageway communicating ambient air with the engine's intake manifold, first means for introducing air in said first passageway, a second air passageway communicating with said intake manifold and second means including compressed air means for simultaneously and selectively increasing the air flow rate in both said first and second passageways wherein said first air passageway is concentrically disposed about said second air passageway, impeller means on said second air passageway defining said second means, rotary and stationary vane means on said first air passageway defining said first means, said impeller means connected to said rotary vane means whereby rotation of said impeller means drives said rotary vane means wherein said impeller means comprise caps disposed on top and bottom portions of said second air passageway, apertures extending through said caps from top to bottom surfaces thereof and said apertures angled relative to said top and bottom surfaces whereby air impinging therethrough causes a rotative reaction by said cap whereby upon demand, the air flow rate is increased in the manifold.

2. The device of claim 1 wherein plural said vanes are provided, stationary and rotary vanes interleaved, each said stationary vane having an outer housing portion and an inner sleeve, said stationary vanes fixed therebetween, said rotary vanes including a central band having a portion slideably disposed within said sleeve and said rotary vanes extending from a portion of said band beyond said sleeve, said rotary vanes extending adjacent a portion of said housing, said housing and band having substantially the same depth.

3. The device of claim 2 including means to nest plural said housings and bands together respectively thereby stacking and increasing said first means.

4. The device of claim 3 wherein said bands form said second air passageway, said caps fixed on extremities of said bands so that driving said caps drives said bands and rotary vanes.

5. The device of claim 4 wherein a shaft extends through said second air passageway, fastening means on said shaft to constrain extreme opposed surfaces of said caps from axial translation, upper and lower carrier frames disposed on upper and lower housing edge portions respectively, said upper carrier frame having an injector plate thereon over said secondary air passage, nozzle means through said injector plate connected to said compressed air means and oriented for air to impinge on said cap means, said lower carrier frame including a lower apertured injector plate over said secondary air passage.

6. The device of claim 5 wherein said compressed air means comprises a compressor pump, an air storage tank interposed between said compressor pump and said nozzle means, a one way check valve between said compressor pump and said storage tank to retard back flow of air from said storage tank to said compressor pump, a valve between said nozzles means and said storage tank activated by said sensing means to introduce air to said second passageway.

7. The device of claim 6 including manifold pressure drop sensing means which, if of sufficient magnitude, actuates said compressed air means.

8. The device of claim 6 including an exhaust gas analyzer means which actuates said compressed air means.

9. The device of claim 6 including throttle position sensing means which, if of sufficient magnitude, actuates said compressed air means.

10. The device of claim 5 including a further said nozzle means oriented to condition said lower cap means with compressed air.

11. The device of claim 6 wherein said cap means includes arcuate air passageways which when contacted by compressed air causes said cap means to rotate.

* * * * *